US011846391B2

(12) United States Patent
Hwang et al.

(10) Patent No.: US 11,846,391 B2
(45) Date of Patent: Dec. 19, 2023

(54) GAS SUPPLY APPARATUS

(71) Applicant: SAMSUNG ELECTRONICS CO., LTD., Suwon-si (KR)

(72) Inventors: Beomsoo Hwang, Seoul (KR); Jongkyu Kim, Suwon-si (KR); Hyunsik Kim, Suwon-si (KR); Kyeongsup Byeon, Suwon-si (KR); Byungjun An, Suwon-si (KR); Byeongchan Jeong, Seoul (KR); Kimoon Lee, Seoul (KR); Hyungho Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/721,881

(22) Filed: Apr. 15, 2022

(65) Prior Publication Data

US 2023/0332747 A1 Oct. 19, 2023

(51) Int. Cl.
*F17C 13/04* (2006.01)
*F17C 13/02* (2006.01)

(52) U.S. Cl.
CPC ..... *F17C 13/04* (2013.01); *F17C 13/02* (2013.01); *F17C 2205/037* (2013.01); *F17C 2205/0329* (2013.01); *F17C 2205/0382* (2013.01); *F17C 2250/0478* (2013.01); *F17C 2260/036* (2013.01)

(58) Field of Classification Search
CPC ..... F17C 13/04; F17C 2205/0329
See application file for complete search history.

(56) References Cited

U.S. PATENT DOCUMENTS

2021/0222834 A1* 7/2021 Choi ..... F17C 13/04

FOREIGN PATENT DOCUMENTS

| | | | |
|---|---|---|---|
| JP | H11345668 | A | 12/1999 |
| JP | 2002321109 | A | 7/2007 |
| KR | 10-0985575 | B1 | 10/2010 |
| KR | 10-2014-0103471 | A | 8/2014 |
| KR | 10-1918451 | B1 | 1/2019 |
| KR | 10-1945157 | B1 | 2/2019 |
| KR | 10-1980045 | B1 | 5/2019 |

(Continued)

OTHER PUBLICATIONS

Korean Office action dated Oct. 5, 2022.

*Primary Examiner* — Paul J Gray
(74) *Attorney, Agent, or Firm* — Muir Patent Law, PLLC

(57) ABSTRACT

A gas supply apparatus includes: a mounting portion installed on a cabinet; a gas supply portion installed on the mounting portion so as to be raisable and lowerable; and a gas container fixing portion fixing a gas container to the gas supply portion, wherein the gas supply portion includes a compressed gas association (CGA) fastening module that is installed on the mounting portion and is detachable from the gas container, and the CGA fastening module includes: a case; an end cap housing rotatably installed on the case; a CGA connector housing installed on the case so as to be disposed adjacent to the end cap housing; a gasket detection sensor installed on a sensor installation mount of the case and disposed under the CGA connector housing; and a power transmission portion spaced apart from the end cap housing and connected to the end cap housing and the CGA connector housing.

10 Claims, 15 Drawing Sheets

(56) References Cited

FOREIGN PATENT DOCUMENTS

| | | | |
|---|---|---|---|
| KR | 10-2019-0070857 | A | 6/2019 |
| KR | 10-2019-0070878 | A | 6/2019 |
| KR | 10-2035697 | B1 | 10/2019 |
| KR | 10-2040713 | B1 | 11/2019 |
| KR | 10-2049326 | B1 | 11/2019 |
| KR | 10-2074249 | B1 | 2/2020 |

* cited by examiner

GAS SUPPLY APPARATUS

BACKGROUND

1. Field

Embodiments relate to a gas supply apparatus.

2. Description of the Related Art

In general, gas used in a semiconductor manufacturing process may be supplied to a manufacturing facility through a gas pipe from a gas container, in which the gas is stored.

SUMMARY

According to an embodiment, a gas supply apparatus may include: a mounting portion installed on a cabinet; a gas supply portion installed on the mounting portion so as to be raisable and lowerable; and a gas container fixing portion fixing a gas container to the gas supply portion, wherein the gas supply portion includes a compressed gas association (CGA) fastening module that is installed on the mounting portion and is detachable from the gas container, and the CGA fastening module includes: a case; an end cap housing rotatably installed on the case; a CGA connector housing installed on the case so as to be disposed adjacent to the end cap housing; a gasket detection sensor installed on a sensor installation mount of the case and disposed under the CGA connector housing; and a power transmission portion spaced apart from the end cap housing and connected to the end cap housing and the CGA connector housing.

BRIEF DESCRIPTION OF DRAWINGS

Features will become apparent to those of skill in the art by describing in detail example embodiments with reference to the attached drawings in which.

DETAILED DESCRIPTION

Hereinafter, example embodiments will now be described in detail with reference to the accompanying drawings.

Mounting Portion

Figure 1:
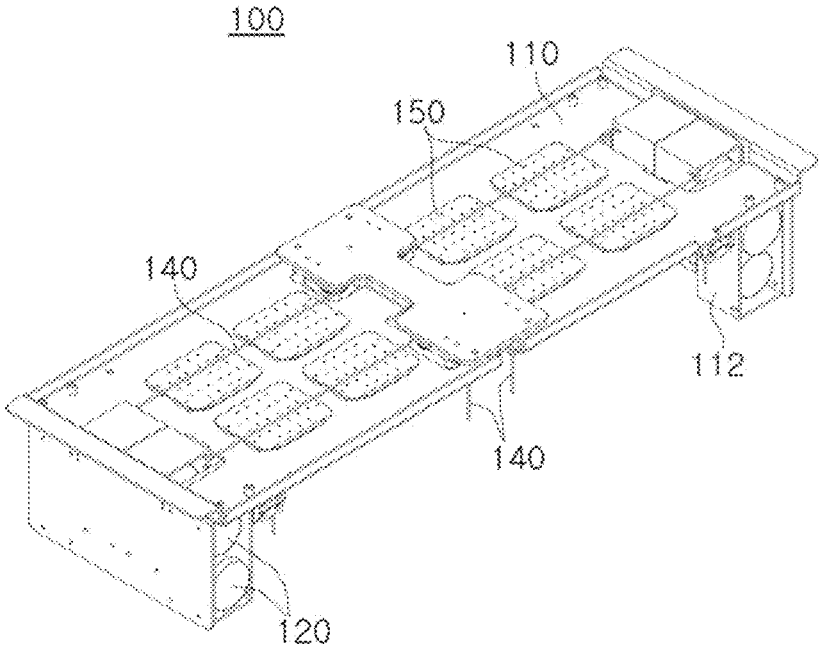
FIG. 1 is a perspective view illustrating a mounting portion according to an example embodiment.
Figure 2:
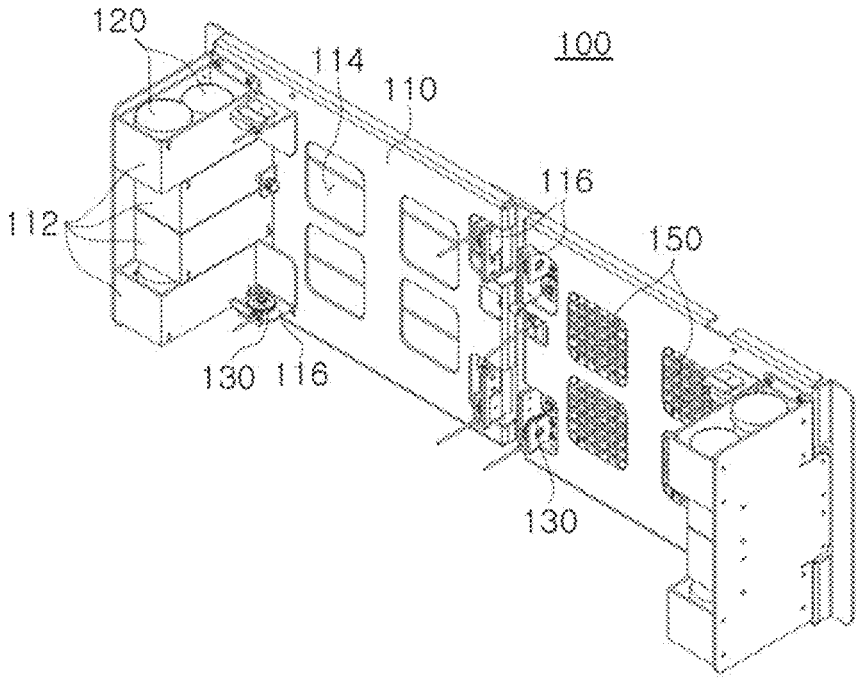
FIG. 2 is a bottom perspective view illustrating the mounting portion according to an example embodiment.

FIG. 1 is a perspective view illustrating a mounting portion according to an example embodiment, and FIG. 2 is a bottom perspective view illustrating the mounting portion according to an example embodiment.

Referring to FIG. 1, a mounting portion 100 may include a frame 110, a spring 120, a pulley 130, a wire 140, and a magnet 150.

The mounting portion 100 may be fixedly installed on a cabinet (not illustrated) in which a gas container (not illustrated) is accommodated.

A gas supply portion, for automatically connecting the gas container and a pipe (not illustrated), may be connected to the mounting portion 100. The gas supply portion may be connected to the wire 140, and may be fixed in a state of being spaced apart from the mounting portion 100 or being in contact with the mounting portion 100.

The frame 110 may have a substantially rectangular plate shape.

An installation tool 112, in which the spring 120 is installed, may be provided at each of both ends of a lower surface of the frame 110.

The installation tool 112 may have a size appropriate to accommodate at least one spring 120. A plurality of installation tools 112, e.g., four installation tools 112, may be provided at both ends of the frame 110.

The frame 110 may have a plurality of mounting holes 114 in which the magnet 150 is installed.

A mounting tool 116 for installation of the pulley 130 may be provided in the frame 110.

The spring 120 may be installed in the installation tool 112 of the frame 110, and one end of the wire 140 may be connected to the spring 120. The wire 140 and the spring 120 may be coupled so that, when the wire 140 is drawn out, the spring 120 is contracted. Thereafter, when a tensile force applied to the wire 140 is removed, the wire 140 may be drawn in by a restoring force of the spring 120.

The spring 120 may be a coil spring, a static load spring, etc. More than one spring 120, e.g., two springs 120, may be arranged so as to form a pair in one installation tool 112 of the frame 110.

A plurality of pulleys 130 may be rotatably installed on the frame 110 so as to be disposed adjacent to a central portion of the frame 110 and the installation tool 112 of the frame 110. The pulley 130 may be rotatably installed on the mounting tool 116 of the frame 110. The number of pulleys 130 installed on the frame 110 may correspond to the number of wires 140. The pulley 130 may serve to guide the wire 140 and to change a direction of the wire 140. A plurality of pulleys 130 may be installed on one mounting tool 116.

The wire 140 may have one end connected to the spring 120 and another end connected to the gas supply portion (not illustrated). The wire 140 may be drawn out while being guided by the pulley 130. A plurality of wires 140, e.g., eight wires 140, may be provided.

The magnet 150 may be installed in the mounting hole 114 of the frame 110. A plurality of magnets 150, e.g., eight magnets 150, may be installed on the frame 110. The magnet 150 may serve to fix the gas supply portion by attaching the gas supply portion with a magnetic force when the gas supply portion is raised. When the gas supply portion is fixed to the magnet 150 by the magnetic force, an operator or person may easily separate the gas supply portion from the mounting portion 100.

With reference to the above, the wire 140 may be connected to the spring 120, and the spring 120 may compensate for a weight of the gas supply portion. Further, the wire 140 may be guided by the pulley 130, which may assist the operator to safely raise and lower the gas supply portion. In addition, the magnet 150 installed on the frame 110 may fix the gas supply portion by magnetic force when the gas supply portion is raised.

Gas Container Fixing Portion

Figure 3:
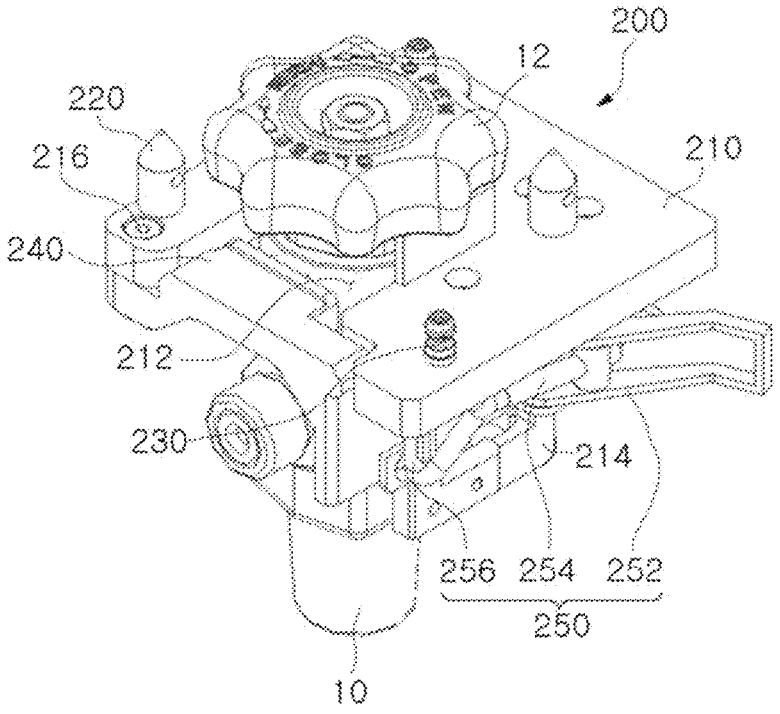
FIG. 3 is a perspective view illustrating a gas container fixing portion according to an example embodiment.

FIG. 3 is a perspective view illustrating a gas container fixing portion according to an example embodiment.

Referring to FIG. 3, for example, a gas container fixing portion 200 may include a main plate 210, a positioning pin 220, a stud bolt 230, a door 240, and a clamp unit 250. FIG. 3 also illustrates a portion of a gas container 10 and its gas valve 12.

The gas container fixing portion 200 may be fixed to the gas container 10 such that the gas valve 12 of the gas container 10 is disposed at an upper portion of the main plate 210. The gas container fixing portion 200 may be fixed to the gas supply portion, and may serve to prevent the gas container 10 from being distorted or moved. After the gas container fixing portion 200 is installed on the gas container 10, the operator may lower the gas supply portion so that the gas container fixing portion 200 and the gas supply portion are fixedly coupled.

The main plate 210 may have an opening 212 through which an upper end portion of the gas container 10 enters and exits. The operator may rotate the door 240 so that the upper end portion of the gas container 10 can be placed into the opening 212 while the opening 212 is open. Thereafter, the door 240 may be rotated to close the opening 212 so that the gas container 10 is fixed. A hinge 216 may be installed in the main plate 210 so that the door 240 can be rotated.

An installation mount 214, on which the clamp unit 250 is installed, may be provided on one side of a lower surface of the main plate 210.

A plurality of positioning pins 220 may be provided on an upper surface of the main plate 210. Each positioning pin 220 may have a tapered upper end portion. For example, the upper end portion of the positioning pin 220 may be tapered so that the positioning pin 220 may be easily coupled to the gas supply portion when the gas supply portion is lowered.

The stud bolt 230 may be fixedly installed on the upper surface of the main plate 210. The number of stud bolts 230 may be plural. When the gas container fixing portion 200 is coupled to the gas supply portion, the stud bolt 230 may be connected to a pneumatic actuator of the gas supply portion, and may serve to fix the main plate 210 to the gas supply portion.

As described above, the door 240 may be rotatably installed on the main plate 210 to open and close the opening 212. To this end, the door 240 may have a shape corresponding to one end of the opening 212. A locking portion of the door may be coupled to the clamp unit 250 on one side of the door 240 such that, in a state in which the door 240 closes the opening 212, the locking portion may be caught by the clamp unit 250 so that the door 240 does not rotate and the closed state of the opening 212 may be maintained. The clamp unit 250 may be provided on the installation mount 214 of the main plate 210. The clamp unit 250 may include a handle 252, a connection portion 254 connected to the handle 252, and a hook 256 provided at an end of the connection portion 254. The handle 252 may be rotatably installed on the main plate 210. The connection portion 254 may be connected to a central portion side of the handle 252, and may be moved according to rotation of the handle 252. As the hook 256 is moved along with the connection portion 254, the hook 256 may be caught or released from the locking portion of the door 240.

As described above, the upper end portion of the gas container 10 may be fixed through the door 240 rotatably installed on the main plate 210, and the stud bolt 230 may be connected to the pneumatic actuator (not illustrated) of the gas supply portion. Accordingly, when the gas container fixing portion 200 is installed on the gas supply portion, the gas container may be prevented from being rotated or moved during the operation of the gas supply portion.

Compressed Gas Association (CGA) Fastening Module

Figure 4:
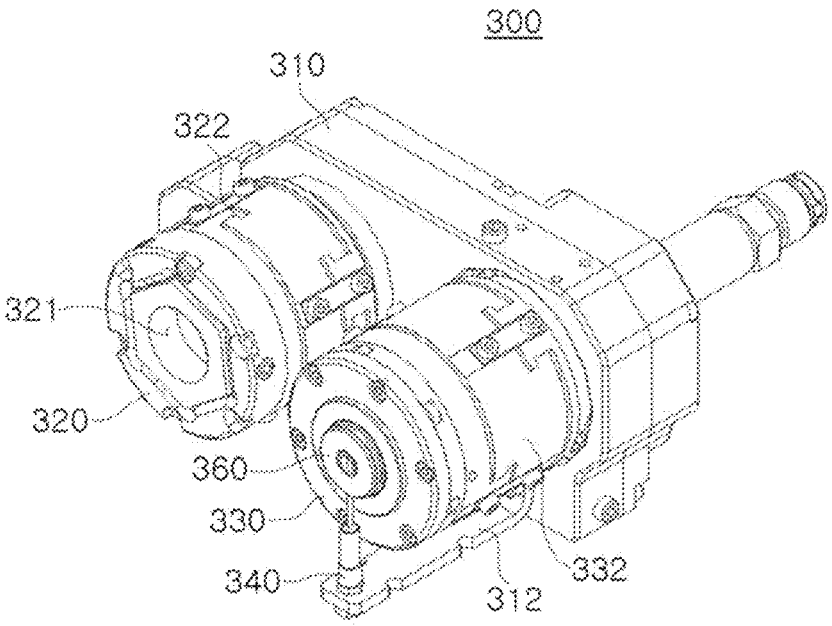
FIG. 4 is a perspective view illustrating a compressed gas association (CGA) fastening module according to an example embodiment.
Figure 5:
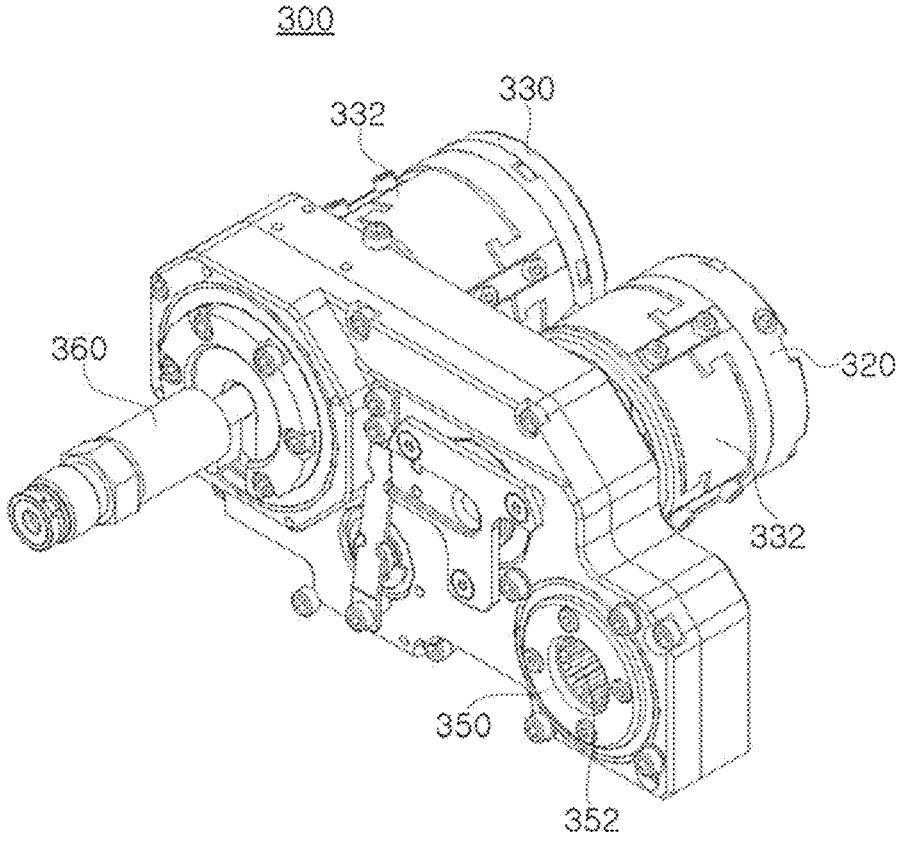
FIG. 5 is a rear perspective view illustrating the CGA fastening module according to an example embodiment.

FIG. 4 is a perspective view illustrating a CGA fastening module according to an example embodiment, and FIG. 5 is a rear perspective view illustrating the CGA fastening module according to an example embodiment.

Referring to FIGS. 4 and 5, a CGA fastening module 300 may include a case 310, an end cap housing 320, a CGA connector housing 330, a gasket detection sensor 340, and a power transmission portion 350.

The end cap housing 320 and the CGA connector housing 330 may be rotatably installed on one surface of the case 310.

The case 310 may have an internal space. A power transmission member (not illustrated), which transmits power received from the power transmission portion 350 to the end cap housing 320 and the CGA connector housing 330, may be provided in the internal space of the case 310.

A CGA connector 360 may be connected to the gas container (not illustrated in FIGS. 4 and 5), and may be installed in the case 310 so as to penetrate through the case 310. One end of the CGA connector 360 may be disposed to protrude from the CGA connector housing 330.

The end cap housing 320 may be rotatably installed on one surface of the case 310. The end cap housing 320 may rotate to remove or install an end cap (not illustrated) of the gas container (not illustrated). To this end, an entry and exit hole 321, through which the end cap enters and exits, may be formed in a front surface of the end cap housing 320. The entry and exit hole 321 may have a shape corresponding to a shape of the end cap. The end cap housing 320 may be connected to the power transmission portion 350 so as to be rotated.

A first flexible coupling 322 may be provided in the end cap housing 320. The first flexible coupling 322 may be tilted so that the end cap may easily enter and exit through the entry and exit hole 321 of the end cap housing 320, e.g., by tilting a front end portion of the end cap housing 320, even if a valve shaft of the gas container and the end cap housing 320 are misaligned, e.g., if the valve shaft of the gas container and the end cap housing 320 are eccentric or disposed to be inclined with respect to each other. Accordingly, when the end cap is coupled to the end cap housing 320, a phenomenon in which a screw thread is not properly fastened and thus not separated may be prevented.

The CGA connector housing 330 may be rotatably installed on one surface of the case 310 so as to be disposed adjacent to the end cap housing 320. The CGA connector housing 330 may rotate so as to couple the CGA connector 360 to the gas container. The CGA connector housing 330 may be connected to the power transmission portion 350 to be rotated.

A second flexible coupling 332 may be provided in the CGA connector housing 330. The second flexible coupling 332 may be tilted so that the CGA connector 360 is accurately coupled to the gas container even if the valve shaft of the gas container and the CGA connector housing 330 are misaligned, e.g., if the valve shaft of the gas container and the CGA connector housing 330 are eccentric or disposed to be inclined with respect to each other. Accordingly, when the CGA connector 360 is coupled to the gas container, a phenomenon in which the screw thread is not properly fastened and thus not separated may be prevented.

A gasket (not illustrated) may be installed at an end of the CGA connector 360 before the CGA connector 360 is coupled to the gas container. The gasket may prevent the gas from leaking from the gas container in a state in which the CGA connector 360 is connected to the gas container. The gasket may be provided at the end of the CGA connector 360.

The gasket detection sensor 340 may be installed on a sensor installation mount 312 provided on the case 310. The sensor installation mount 312 may be provided on one surface of the case 310 so as to be disposed under the CGA connector housing 330. The gasket detection sensor 340 may be installed at the end of the sensor installation mount 312 to detect whether or not the gasket (not illustrated) is present at the end of the CGA connector 360 disposed to penetrate through the CGA connector housing 330.

The power transmission portion 350 may be installed in the case 310 so as to be disposed adjacent to the end cap housing 320. The power transmission portion 350 may be connected to the power transmission member (not illustrated) disposed inside the case 310 to transmit power to the end cap housing 320 and the CGA connector housing 330. A gear 352 may be connected to a power transmission shaft (not illustrated), and may be provided in the power transmission portion 350.

As described above, the first and second flexible couplings 322 and 332 are provided in the end cap housing 320 and the CGA connector housing 330, respectively, and thus eccentricity and a deviation angle that may occur (e.g., depending on a skill level of the operator and assembly accuracy) may be compensated for, such that the end cap may be easily separated from the gas container, and the CGA connector 360 may be accurately fastened to the gas container.

In addition, the gasket detection sensor 340 may be provided to detect whether or not the gasket is provided on the CGA connector 360, and thus gas leakage due to the gasket not being present or inserted may be prevented.

Driving Portion for CGA Fastening Module

Figure 6:
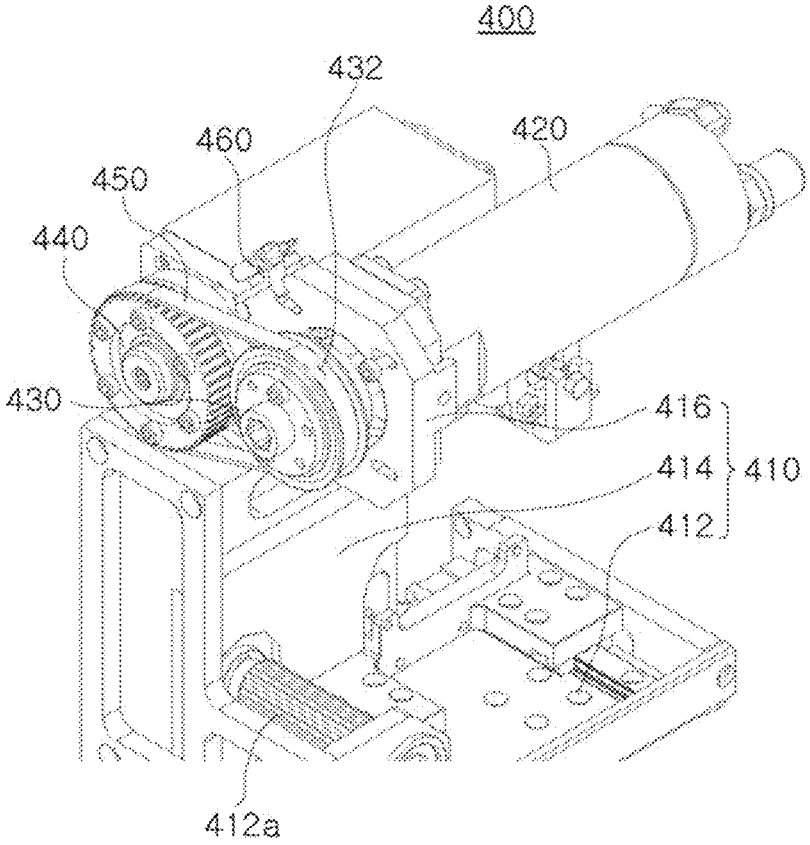
FIG. 6 is a perspective view illustrating a driving portion for the CGA fastening module according to an example embodiment.

FIG. 6 is a perspective view illustrating a driving portion for the CGA fastening module according to an example embodiment.

Referring to FIG. 6, a driving portion 400 for the CGA fastening module may include a main body 410, a pneumatic actuator 420, a power transmission portion 430, a torque limiter 440, a belt 450, and a fiber sensor 460.

The main body 410 may have provided therein a CGA fastening module fastening portion 412 (on which the CGA fastening module 300 (see FIGS. 4 and 5) is installed), an extension portion 414 (extending upward from the CGA fastening module fastening portion 412 and having an internal space), and a driving portion installation portion 416.

The CGA fastening module fastening portion 412 may include a power transmission shaft **412*a* coupled to the power transmission portion 350 (see FIG. 5) of the CGA fastening module 300. The pneumatic actuator 420 may be connected to the power transmission shaft 412*a***.

A plurality of power transmission members (not illustrated) may be installed in the extension portion 414, and the power transmission shaft **412*a*** may rotate by receiving power through the power transmission members.

The pneumatic actuator 420, the power transmission portion 430, and the torque limiter 440 may be installed on the driving portion installation portion 416.

The pneumatic actuator 420 may be installed on one surface of the driving portion installation portion 416. The pneumatic actuator 420 may generate a rotational force.

Using the pneumatic actuator 420 as a driving source may avoid hazards presented by using an electric actuator (such as a servo motor or a step motor) for a gas container having a flammable characteristic that presents a risk of fire and explosion.

The power transmission portion 430 may be connected to the pneumatic actuator 420 so as to be rotated by the pneumatic actuator 420. The belt 450, which transmits the rotational force transmitted from the pneumatic actuator 420 to the torque limiter 440, may be installed on the power transmission portion 430. To this end, the power transmission portion 430 may have a belt installation groove 432.

The torque limiter 440 may be connected to the power transmission portion 430 through the belt 450, and may be rotatably installed on the driving portion installation portion 416. The torque limiter 440 may release power transmission through a mechanical change when a torque equal to or greater than a reference torque is received. For example, the torque limiter 440 may have a deformable portion (not illustrated) that is mechanically changed when a torque equal to or greater than the reference torque is received.

The belt 450 may connect the power transmission portion 430 and the torque limiter 440. Although, a case where the power transmission portion 430 and the torque limiter 440 are connected through the belt 450 has been described as an example, the connection between the power transmission portion 430 and the torque limiter 440 may be varied, e.g., the power transmission portion 430 and the torque limiter 440 may be connected with a chain or the like.

The fiber sensor 460 may be installed on the driving portion installation portion 416, and may detect deformation of the deformable portion of the torque limiter 440. When the deformation of the deformable portion of the torque limiter 440 is detected by the fiber sensor 460, the operation of the pneumatic actuator 420 may be stopped according to a signal from the fiber sensor 460. Accordingly, when a torque equal to or greater than the reference torque is provided, the pneumatic actuator 420 may be stopped and no more torque may be transmitted.

As described above, when a torque equal to or greater than the reference torque is provided, the torque limiter 440 may release power transmission, such that the pneumatic actuator may be operated within a limited torque range, and as a result, the CGA fastening module 300 may be smoothly operated. Accordingly, the gas may be stably supplied while ensuring the safety of the operator.

CGA Pipe Fixing Module

Figure 7:
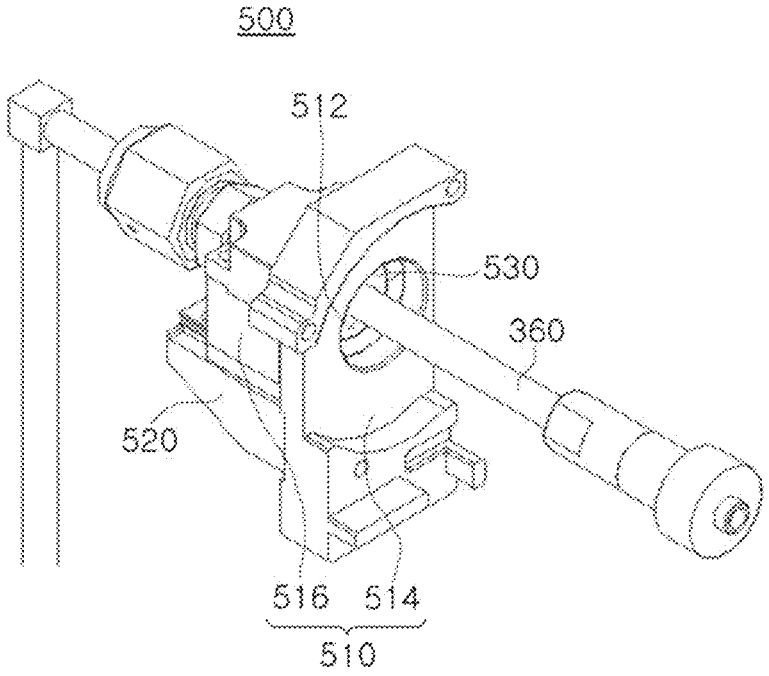
FIG. 7 is a perspective view illustrating a CGA pipe fixing module according to an example embodiment.

FIG. 7 is a perspective view illustrating a CGA pipe fixing module according to an example embodiment.

Referring to FIG. 7, a CGA pipe fixing module 500 may include a fixing portion housing 510, a linear motion (LM) guide 520, and an elastic body 530.

The fixing portion housing 510 may be movably installed on the LM guide 520.

The fixing portion housing 510 may have a through-hole 512 through which the CGA connector 360 passes. The through-hole 512 may have a larger diameter than that of a CGA pipe 502.

The fixing portion housing 510 may include a main body portion 514 and an extension portion 516 extending from the main body portion 514. The extension portion 516 may be slidably installed on the LM guide 520. The main body portion 514 may have a larger size than the LM guide 520, and accordingly, the main body portion 514 of the fixing portion housing 510 may be restricted in movement by the LM guide 520.

The LM guide 520 may serve to guide the fixing portion housing 510 such that the fixing portion housing 510 may move along the LM guide 520. When the fixing portion housing 510 is moved forward (e.g., in order to install the gasket (not illustrated) on the CGA connector 360), the fixing portion housing 510 may move along the LM guide 520. Thereafter, when the CGA connector 360 is fastened to the gas container, the fixing portion housing 510 may move along the LM guide 520 to retract.

The elastic body 530 may be fixedly installed in the through-hole 512 of the fixing portion housing 510. The CGA pipe 502 may pass through the elastic body 530. The CGA pipe 502 may be fixedly installed on the elastic body 530. With the CGA pipe 502 fixedly installed on the elastic body 530, the degree of freedom of the CGA pipe 502 may be defined or secured. As a result, deformation of the CGA pipe 502 (e.g., due to a stroke generated when the CGA connector 360 is fastened to the gas container) may be offset by a restoring force of the elastic body 530.

As described above, the deformation of the CGA pipe 502 may be prevented by using the elastic body 530.

CGA Pipe

Figure 8:
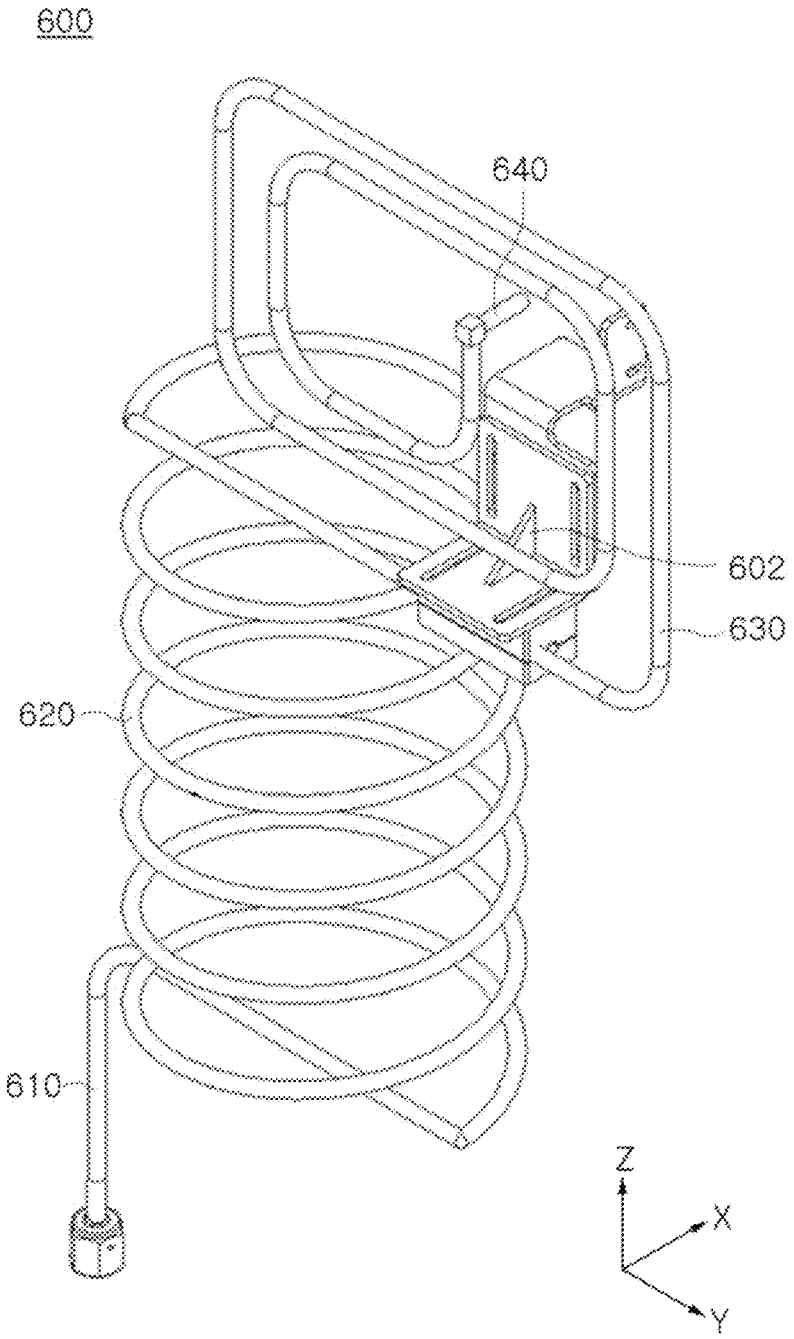
FIG. 8 is a perspective view illustrating a CGA pipe according to an example embodiment.

FIG. 8 is a perspective view illustrating a CGA pipe according to an example embodiment.

Referring to FIG. 8, a CGA pipe 600 may include a first CGA pipe 610, a coil portion 620, a spiral portion 630, and a second CGA pipe 640.

The first CGA pipe 610 may have one end connected to the coil portion 620. The first CGA pipe 610 may have a curved shape, e.g., the first CGA pipe 610 may have a shape that is bent from a Z-axis direction toward a Y-axis direction.

The coil portion 620 may be disposed to extend in the Z-axis direction. One end of the coil portion 620 may be connected to the first CGA pipe 610 disposed in the Y-axis direction, and another end of the coil portion 620 may be connected to the spiral portion 630. The coil portion 620 disposed in the Z-axis direction as described may serve to prevent the coil portion 620 from being permanently deformed when the coil portion 620 is compressed or extended, e.g., when the gas supply portion (not illustrated) is raised or lowered.

FIG. 8 illustrates a case where the coil portion 620 has a circular coil shape, as an example, but the coil portion 620 may have various shapes such as a polygonal coil shape, an elliptical coil shape, etc.

The spiral portion 630 may be disposed in an XY plane, and may have a rectangular spiral shape. The spiral portion 630 may have one end connected to the coil portion 620 and another end connected to the second CGA pipe 640.

The spiral portion 630 may be partially fixed to a bracket 602. The bracket 602 may be fixedly installed on the gas supply portion. In this way, with the spiral portion 630 fixed to the bracket 602, the CGA pipe 600 may be prevented from being deformed by its own weight.

As described above, the spiral portion 630 may have a rectangular spiral shape and, thus, when the CGA connector 360 connected to the second CGA pipe 640 is fastened to the gas container, the spiral portion 630 may be prevented from being permanently deformed when being extended or compressed in an X-axis direction.

FIG. 8 illustrates a case where the spiral portion 630 has a rectangular spiral shape, as an example, but the spiral portion 630 may have various shapes such as a polygonal spiral shape (other than the rectangular spiral shape), a circular spiral shape, an elliptical spiral shape, etc.

The second CGA pipe 640 may have one end connected to the spiral portion 630 and disposed in the X-axis direction.

As described above, the CGA pipe 600 may be prevented from being permanently deformed in the Z-axis direction and the X-axis direction by using the coil portion 620 and the spiral portion 630.

Valve Rotation Driving Module of Gas Container

Figure 9:
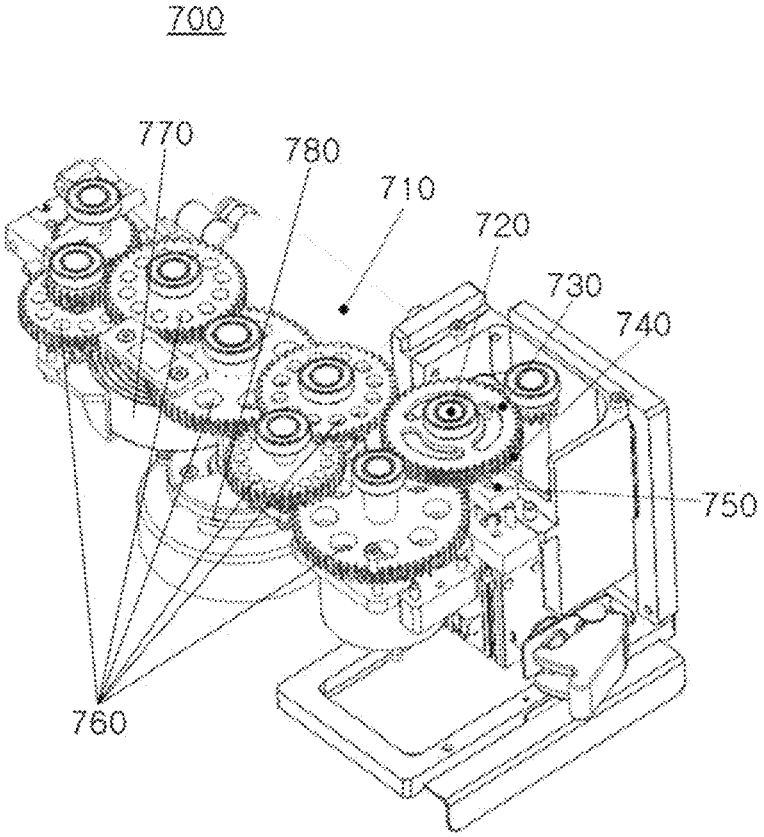
FIG. 9 is a schematic perspective view illustrating a valve rotation driving module for a gas container according to an example embodiment.
Figure 10:
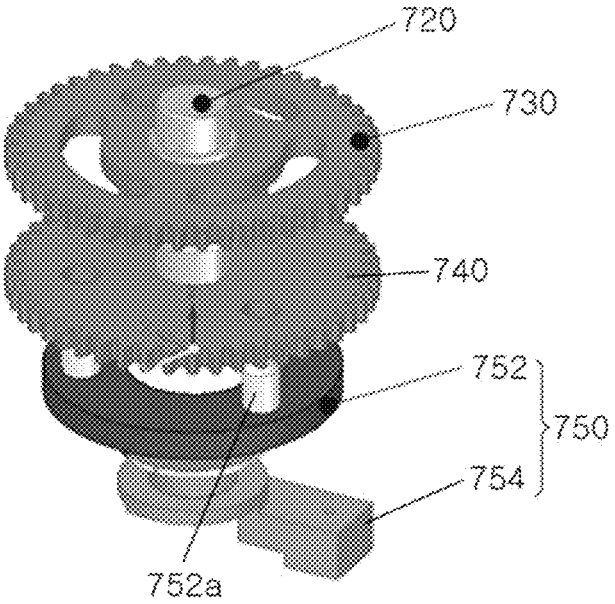
FIG. 10 is a configuration diagram illustrating a clutch gear and a vertical movement module of the valve rotation driving module of the gas container according to an example embodiment.

FIG. 9 is a schematic perspective view illustrating a valve rotation driving module for the gas container, according to an example embodiment, and FIG. 10 is a configuration diagram illustrating a clutch gear and a vertical movement module of the valve rotation driving module of the gas container, according to an example embodiment.

Referring to FIGS. 9 and 10, a valve rotation driving module 700 for the gas container may include an actuator 710, a main gear shaft 720, a main power transmission gear 730, a clutch gear 740, a vertical movement unit 750, a plurality of driven gears 760, a spring unit 770, and a valve handle 780.

The actuator 710 may generate a driving force and be connected to the main power transmission gear 730. The actuator 710 may be a pneumatic actuator. The actuator 710 may be fixedly installed on the main frame 702.

The main power transmission gear 730, the clutch gear 740, and the vertical movement unit 750 may be installed on the main gear shaft 720. The clutch gear 740 and the vertical movement unit 750 may be installed on the main gear shaft 720 so as to be raisable and lowerable. The main gear shaft 720 may provide a path through which the clutch gear 740 and the vertical movement unit 750 are raised and lowered when the clutch gear 740 is raised and lowered.

The main power transmission gear 730 may be installed on the main gear shaft 720, and may be connected to the actuator 710. The main power transmission gear 730 may be connected to the actuator 710 so as to rotate around the main gear shaft 720 when the actuator 710 is operated.

As described above, the clutch gear 740 may be installed on the main gear shaft 720 so as to be raisable and lowerable. When the clutch gear 740 is raised and coupled to the main power transmission gear 730, the clutch gear 740 may be connected to one of the plurality of driven gears 760. In this case, the driving force transmitted from the main power transmission gear 730 may be transmitted to the plurality of driven gears 760 via the clutch gear 740. On the other hand, when the clutch gear 740 is lowered and decoupled or separated from the main power transmission gear 730, the clutch gear 740 may be separated from the driven gear 760, and the power transmitted from the main power transmission gear 730 may not be transmitted to the plurality of driven gears 760.

The vertical movement unit 750 may be installed to be raisable and lowerable on the main gear shaft 720, and may serve to raise and lower the clutch gear 740. The vertical movement unit 750 may include a ring member 752 including a coupling pin 752*a*, and a connection member 754 connected to the ring member 752. The ring member 752 and the connection member 754 may be installed on the main gear shaft 720 so as to be raisable and lowerable.

The coupling pin 752*a* of the ring member 752 may be coupled to the clutch gear 740 to connect the clutch gear 740 to the main power transmission gear 730 when the clutch gear 740 is raised.

The connection member 754 may be connected to a driving source (not illustrated), and may serve to transmit a driving force for raising and lowering the clutch gear 740 to the clutch gear 740.

The driven gear 760 may serve to transmit the driving force to the valve handle 780. The number of driven gears 760 may be plural, and any one of the plurality of driven gears 760 may be connected to the clutch gear 740 or spaced apart from the clutch gear 740.

The spring unit 770 may be connected to the valve handle 780, and may be configured such that, when the valve handle 780 rotates to open the gas container, a state may be maintained in which a spring (not shown) formed of as clockwork spring is compressed. Thereafter, when connection between the clutch gear 740 and the driven gear 760 is released, the valve handle 780 may close the gas container by a restoring or expanding force of the spring of the spring unit 770.

The valve handle 780 may be connected to one of the spring unit 770 and the plurality of driven gears 760 to rotate the valve of the gas container.

As described above, when the valve of the gas container is opened by the clutch gear 740, the power from the actuator 710 may be transmitted to the valve handle. On the other hand, when the valve of the gas container is closed, the power from the actuator 710 may be cut off and the restoring force of the spring of the spring unit 770 may be used and, as a result, the valve of the gas container may be closed even when the power is cut off, e.g., in an emergency.

By way of comparison, in an apparatus in which the power of the actuator is not cut off, a power loss may occur due to a load of the actuator, such that a size of the valve rotation driving module of the gas container may need to be increased, which is disadvantageous. However, according to the present example embodiment, the load of the actuator 710 may be removed through the clutch gear 740, and thus the power loss may be reduced.

Valve Opening and Closing Detection Module of Gas Container

Figure 11:
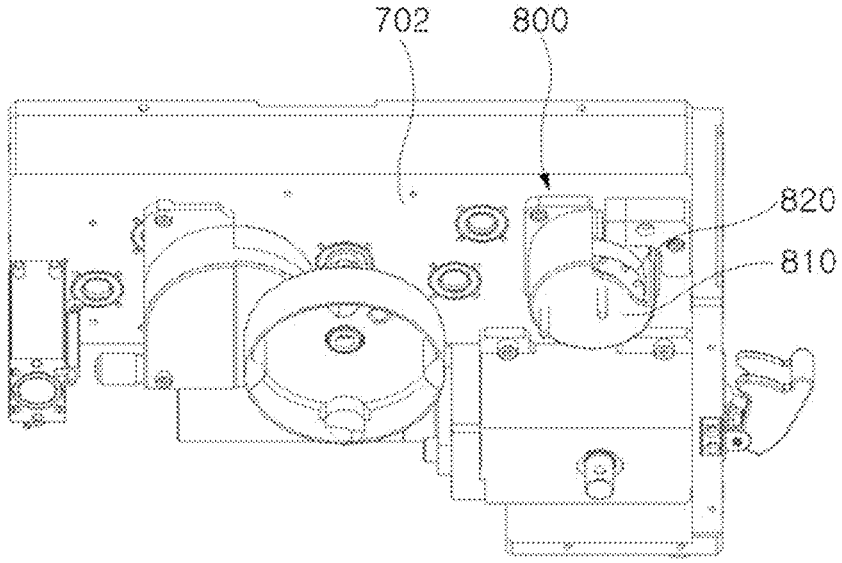
FIG. 11 is a perspective view illustrating a valve opening and closing detection module of the gas container according to an example embodiment.
Figure 12:
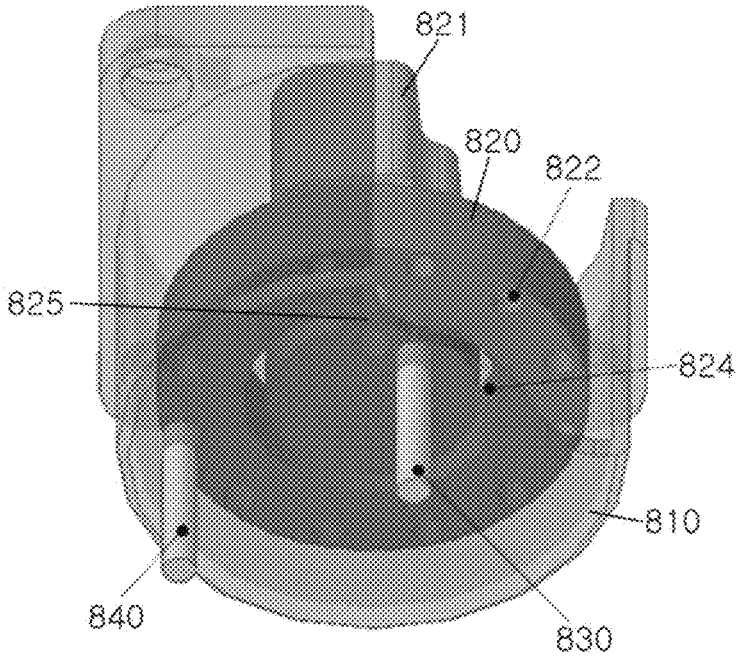
FIG. 12 is a configuration diagram illustrating the valve opening and closing detection module of the gas container according to an example embodiment.

FIG. 11 is a perspective view illustrating a valve opening and closing detection module of the gas container according to an example embodiment, and FIG. 12 is a configuration diagram illustrating the valve opening and closing detection module of the gas container according to an example embodiment.

Referring to FIGS. 11 and 12, a valve opening and closing detection module 800 of the gas container may be installed on the main frame 702 (see FIG. 9) so as to be connected to the valve rotation driving module 700 (see FIG. 9) of the gas container.

The valve opening and closing detection module 800 of the gas container may include a bracket 810, a rotating member 820, a first fiber sensor 830, and a second fiber sensor 840.

The bracket 810 may have an internal space, and may be fixedly installed on a lower surface of the main frame 702. As an example, the bracket 810 may have a cylindrical shape with one side open. The rotating member 820 and the first and second fiber sensors 830 and 840 may be disposed in the internal space of the bracket 810.

The rotating member 820 may be connected to any one of the plurality of driven gears 760 (see FIG. 9) of the valve rotation driving module 700 of the gas container, and may rotate. For example, the rotating member 820 may be coupled to a shaft (not illustrated) installed on any one of the plurality of driven gears 760, and may rotate together with the shaft. To this end, a shaft connection portion 821 may be provided on an upper surface of the rotating member 820.

Further, a plurality of rotation angle detection holes 822 may be disposed on a lower surface of the rotating member 820 so as to be spaced apart from each other. The rotation angle detection hole 822 may be disposed at an edge of the lower surface of the rotating member 820.

A rotational speed detection hole 824 having a substantial ring shape may be disposed inside the rotation angle detection hole 822, and may be provided in the lower surface of the rotating member 820. In an example embodiment, the rotational speed detection hole 824 is not connected by a support portion 825 of the rotating member 820 and does not have a complete ring shape.

The first fiber sensor 830 may be installed on the bracket 810 to detect the rotational speed detection hole 824. For example, the first fiber sensor 830 may be installed on the bracket 810 so as to face the rotational speed detection hole 824. The first fiber sensor 830 may detect a rotational speed of the rotating member 820 by detecting the support portion 825 of the rotating member 820. Thus, the rotational speed of the rotating member 820 may be detected based on the number of times the first fiber sensor 830 detects the support portion 825.

The second fiber sensor 840 may be installed on the bracket 810 to detect the rotation angle detection hole 822. For example, the second fiber sensor 840 may be installed on the bracket 810 so as to face the rotation angle detection hole 822. The second fiber sensor 840 may detect a rotation angle of the rotating member 820 by detecting a plurality of rotation angle detection holes 822, which are arranged to be spaced apart from each other. Thus, the second fiber sensor 840 may detect the rotation angle of the rotating member 820 based on the number of times the plurality of rotation angle detection holes 822, which are arranged at the same interval, are detected.

As described above, the first and second fiber sensors 830 and 840 may detect the rotational speed and the rotation angle based on a change in quantity of received light. However, the first and second fiber sensors 830 and 840 may be varied, and the type of the sensor may be changed.

As described above, the first and second fiber sensors 830 and 840 may detect a rotation angle and rotational speed of the valve handle 780 (see FIG. 9), e.g., the first and second fiber sensors 830 and 840 may detect the rotation angle and rotational speed of the rotating member 820 to detect the rotation angle and rotational speed of the valve handle 780.

Gasket Replacement Module

Figure 13:
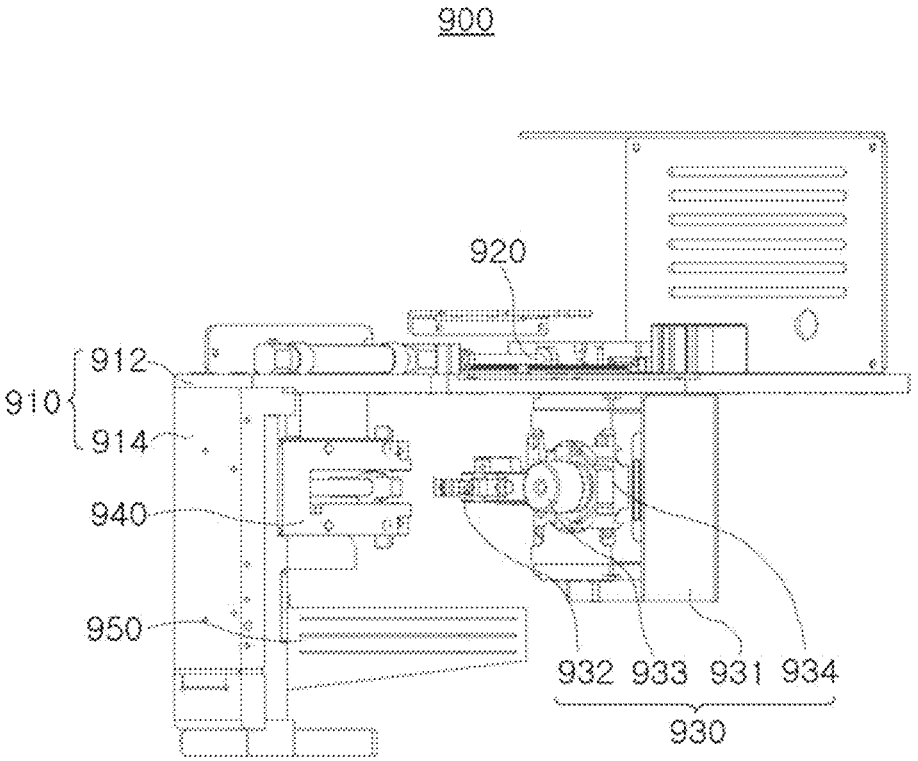
FIG. 13 is a schematic perspective view illustrating a gasket replacement module according to an example embodiment.

FIG. 13 is a schematic perspective view illustrating a gasket replacement module according to an example embodiment.

Referring to FIG. 13, a gasket replacement module 900 may include a main body 910, a forward-reverse actuator 920, a gasket replacement unit 930, a gasket magazine 940, and a gasket removal box 950.

The main body 910 may form an outer shape of the gasket replacement module 900, and may include an upper plate 912 having a plate shape and a side plate 914 extending from one end of the upper plate 912. The forward-reverse actuator 920 may be installed on an upper surface of the upper plate 912, and the gasket replacement unit 930 may be movably installed on a lower surface of the upper plate 912. The gasket magazine 940 may be installed on one surface of the side plate 914 so as to face the gasket replacement unit 930, and the gasket removal box 950 may be installed on the side plate 914 so as to be disposed below the gasket magazine 940.

The forward-reverse actuator 920 may be fixedly installed on the upper surface of the upper plate 912 of the main body 910, and may be connected to the gasket replacement unit 930 to move the gasket replacement unit 930 forward and backward. When the gasket replacement unit 930 is to grip a gasket (not illustrated) from the gasket magazine 940, the gasket replacement unit 930 may be moved forward by the forward-reverse actuator 920. Thereafter, after the gasket is gripped by the gasket replacement unit 930, the gasket replacement unit 930 may be moved backward by the forward-reverse actuator 920. As an example, the forward-reverse actuator 920 may be implemented by a cylinder, and a rod of the forward-reverse actuator 920 may be connected to the gasket replacement unit 930.

The gasket replacement unit 930 may be movably installed on a lower surface of the upper plate 912 of the main body 910.

The gasket replacement unit 930 may include a case 931, a gasket gripper 932, a CGA plug 933, and a phase change actuator 934.

The case 931 may be installed on the main body 910 so as to be connected to the forward-reverse actuator 920. The case 931 may have a rectangular box shape having an internal space, and various components driving the gasket gripper 932 and the CGA plug 933 may be disposed in the internal space of the case 931.

The gasket gripper 932 may be installed on the case 931 so as to be disposed on a front surface of the case 931. The gasket gripper 932 may be installed on the case 931 so that a position change with the CGA plug 933 is possible. Then, when the case 931 is moved forward and enters the gasket magazine 940, the gasket gripper 932 may grip the gasket and take out the gasket. Thereafter, the case 931 may be moved backward to take out the gasket gripper 932 from the gasket magazine 940, and then rotate 180 degrees to change the position with the CGA plug 933. To this end, the gasket gripper 932 may be connected to the phase change actuator 934. As an example, the gasket gripper 932 may be installed on an installation plate (not illustrated) provided on the case 931, and the installation plate may be connected to the phase change actuator 934 and rotate.

The CGA plug 933 may be installed on the case 931 so as to be disposed adjacent to the gasket gripper 932. The CGA plug 933 may also be connected to the phase change actuator 934. As an example, the CGA plug 933 may also be installed on the installation plate (not illustrated) provided on the case 931, and the installation plate may be connected to the phase change actuator 934 and rotate, such that the CGA plug 933 may change the position with the gasket gripper 932. Further, the CGA plug 933 may be installed on a CGA pipe (not illustrated) to prevent gas remaining in the CGA pipe from leaking when the CGA pipe (not illustrated) is separated from the gas container (not illustrated).

The gasket magazine 940 may be installed on the side plate 914 of the main body 910 so as to face the gasket gripper 932. A plurality of gaskets may be stored in the gasket magazine 940.

The gasket removal box 950 may be installed on the side plate 914 of the main body 910 so as to be disposed below the gasket magazine 940. The gasket gripper 932 may store the used gasket in the gasket removal box 950.

As described above, the gasket replacement unit 930 may be moved forward and backward by the forward-reverse actuator 920, and the gasket gripper 932 and the CGA plug 933 may be installed on the case 931 so that the mutual position change is possible. Thus, the gasket gripper 932 and the CGA plug 933 may be smoothly operated even within a narrow space.

Gasket Detection Sensor for CGA Fastening Module

Figure 14:
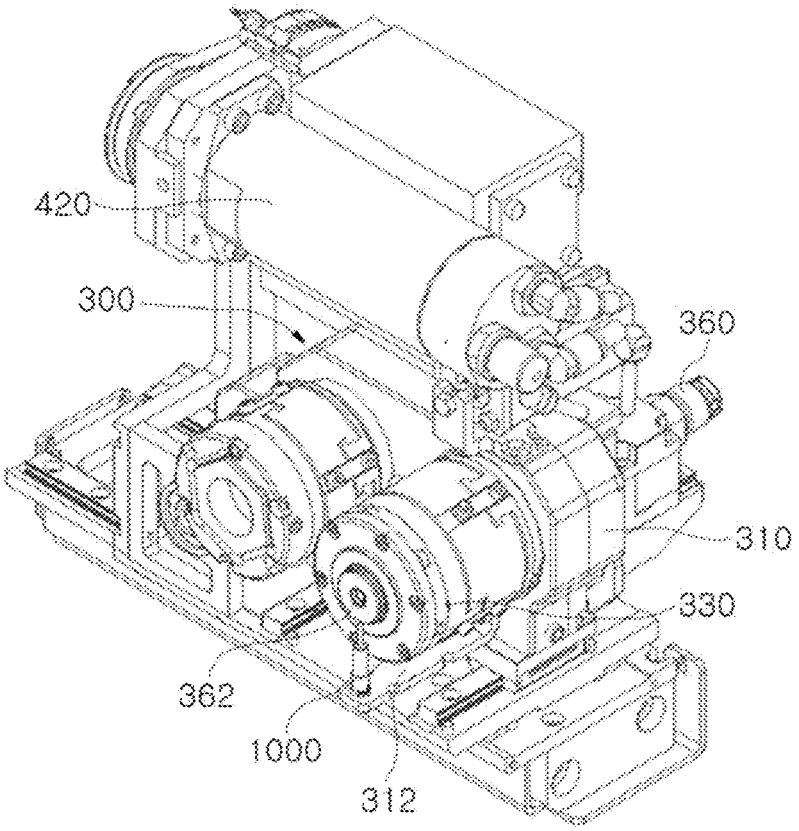
FIG. 14 is a perspective view illustrating an installation state of a gasket detection sensor for the CGA fastening module according to an example embodiment.
Figure 15:
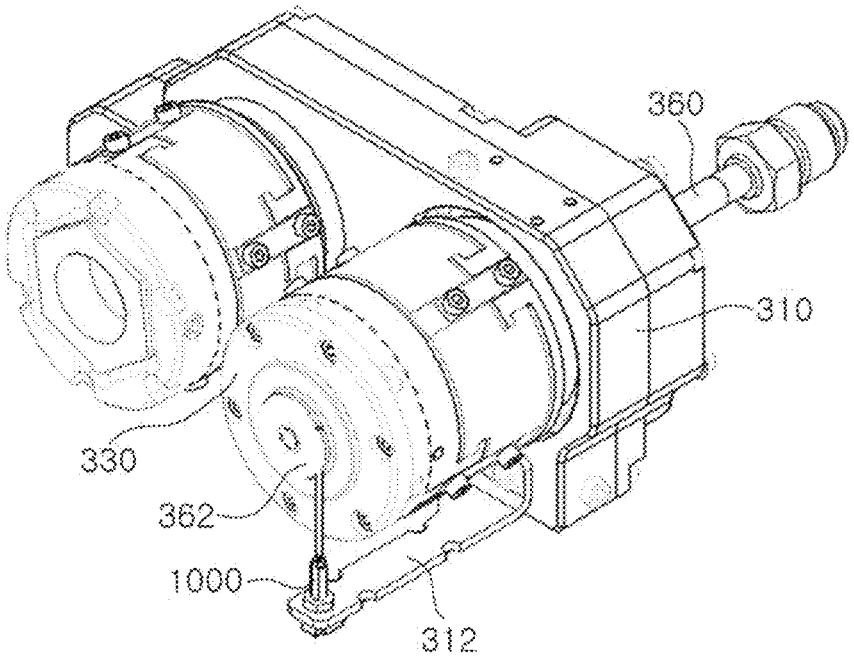
FIG. 15 is a perspective view for describing an installation position of the gasket detection sensor for the CGA fastening module according to an example embodiment.

FIG. 14 is a perspective view illustrating an installation state of a gasket detection sensor for the CGA fastening module according to an example embodiment, and FIG. 15 is a perspective view for describing an installation position of the gasket detection sensor for the CGA fastening module according to an example embodiment.

Referring to FIGS. 14 and 15, a gasket detection sensor 1000 for the CGA fastening module may be installed in the case 310 of the CGA fastening module 300. For example, the gasket detection sensor 1000 may be installed on a sensor installation mount 312 provided on the case 310.

The gasket detection sensor 1000 may serve to detect the gasket installed at the end of the CGA connector 360 disposed to penetrate through the CGA connector housing 330.

The gasket may be installed on a gland nose 362 protruding from the center of the CGA connector 360. The gland nose 362 may have a curved surface, and thus the quantity of light received by the gasket detection sensor 1000 may be high when sensing with the gasket detection sensor 1000. If the gasket detection sensor 1000 were to be positioned at the center of the CGA connector 360 and sense the gland nose 362, it could be difficult to identify the presence or absence of the gasket. Accordingly, the gasket detection sensor 1000 may be disposed to be eccentric from the center of the CGA connector 360, such that the gasket detection sensor 1000 does not sense the gland nose 362, and the quantity of received light may vary largely in dependence on the presence or absence of the gasket, such that the presence or absence of the gasket may be more accurately detected.

Additionally, there may be a case where the gasket detection sensor 1000 has difficulty in detecting the gasket due to the tolerance of the gasket. In this case, the gasket detection sensor 1000 may detect the gasket after adjusting the position of the gasket by rotating the CGA connector 360 using the pneumatic actuator 420 of the driving portion 400 for the CGA fastening module (see FIG. 6).

By way of summation and review, when a process gas in a gas container is exhausted and the gas container is to be replaced, a series of replacement operations (generally, a gas container replacement operation) may include connection and disconnection of the gas container to and from a gas pipe, replacement of a gasket of a gas pipe connection portion, and opening and closing of a valve provided in the gas container. The process gas may have properties such as flammability, corrosiveness, toxicity, etc., and thus workers and the environment may be harmed if the gas leaks or from coming into contact with residual gas. As such, considerable attention should be paid to safety measures during the gas container replacement operation.

As set forth above, embodiments may provide a gas supply apparatus that provides for a gas container to be automatically connected.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A gas supply apparatus, comprising:

a mounting portion configured to be installed on a cabinet;

a gas supply portion installed on the mounting portion so as to be raisable and lowerable; and a gas container fixing portion fixing a gas container to the gas supply portion, wherein the gas supply portion includes a compressed gas association (CGA) fastening module that is installed on the mounting portion and is detachable from the gas container, the CGA fastening module including:

a case;

an end cap housing rotatably installed on the case;

a CGA connector housing installed on the case so as to be disposed adjacent to the end cap housing;

a gasket detection sensor installed on a sensor installation mount of the case and disposed under the CGA connector housing adjacent to a gland nose of the CGA connector and eccentric from the center of the CGA connector; and a power transmission portion spaced apart from the end cap housing and connected to the end cap housing and the CGA connector housing.

2. The gas supply apparatus as claimed in claim 1, wherein the end cap housing includes:

an entry and exit hole disposed in a front surface of the end cap housing, and through which an end cap of the gas container enters and exits, and a first flexible coupling for tilting of a front end portion of the end cap housing.

3. The gas supply apparatus as claimed in claim 1, wherein:

a CGA connector is installed to penetrate through the CGA connector housing, and a second flexible coupling for tilting of a front end portion is provided in the CGA connector housing.

4. The gas supply apparatus as claimed in claim 3, wherein the gasket detection sensor is configured to detect a presence or absence of a gasket at an end of the CGA connector.

5. The gas supply apparatus as claimed in claim 1, wherein the gas supply portion further includes a valve rotation driving module for the gas container, the valve rotation driving module being disposed adjacent to the CGA fastening module, and including:

an actuator configured to provide a driving force;

a main gear shaft connected to the actuator;

a main power transmission gear installed on the main gear shaft;

a clutch gear coupled to or separated from the main power transmission gear;

a vertical movement unit installed on the main gear shaft to raise and lower the clutch gear;

a plurality of driven gears connected to the main power transmission gear;

a spring unit connected to any one of the plurality of driven gears; and a valve handle connected to the spring unit and configured to rotate a valve of the gas container.

6. The gas supply apparatus as claimed in claim 5, wherein:

the vertical movement unit includes a ring member including a coupling pin, and a connection member connected to the ring member, and the connection member is connected to a driving source and installed on the main gear shaft so as to be raisable and lowerable.

7. The gas supply apparatus as claimed in claim 1, wherein the gas supply portion further includes a gasket replacement module, including:

a main body including an upper plate having a plate shape and a side plate extending from one end of the upper plate;

a forward-reverse actuator fixedly installed on an upper surface of the upper plate;

a gasket replacement unit connected to the forward-reverse actuator and configured to be moved forward and backward;

a gasket magazine installed on the side plate so as to face the gasket replacement unit; and a gasket removal box installed on the side plate so as to be disposed below the gasket magazine.

8. The gas supply apparatus as claimed in claim 7, wherein the gasket replacement unit includes:

a case installed on a lower surface of the upper plate;

a gasket gripper installed on the case so as to be disposed on a front surface of the case;

a CGA plug installed on the case so as to be disposed adjacent to the gasket gripper; and a phase change actuator connected to the gasket gripper and the CGA plug.

9. The gas supply apparatus as claimed in claim 1, wherein the mounting portion includes:

a frame having a plate shape and having a plurality of mounting holes;

a spring installed in an installation tool provided on the frame;

a plurality of pulleys rotatably installed on the frame so as to be disposed adjacent to the installation tool;

wires each having one end connected to the spring and another end connected to the gas supply portion; and a magnet installed in the mounting hole of the frame.

10. The gas supply apparatus as claimed in claim 9, wherein the plurality of pulleys are provided on mounting tools so as to change directions of the wires and guide the wires.

* * * * *